United States Patent [19]

Schellstede

[11] Patent Number: 4,765,173

[45] Date of Patent: Aug. 23, 1988

[54] WELL PENETRATION APPARATUS

[76] Inventor: Herman J. Schellstede, 342 Duperier Ave., New Iberia, La. 70560

[21] Appl. No.: 898,515

[22] Filed: Aug. 21, 1986

Related U.S. Application Data

[62] Division of Ser. No. 721,848, Apr. 9, 1985, Pat. No. 4,640,362.

[51] Int. Cl.[4] ..... B21D 28/28; B21D 28/26; B21D 28/34

[52] U.S. Cl. ..... 72/325; 30/366; 83/660; 137/318; 166/55.2; 222/80

[58] Field of Search ..... 72/325; 83/660, 684, 83/30, 691, 651, 697, 188; 137/318; 222/81, 80, 83; 166/55, 55.1, 55.2, 55.3; 175/286, 267; 30/366–368, 315, 359, 360

[56] References Cited

U.S. PATENT DOCUMENTS

| | | | |
|---|---|---|---|
| 134,214 | 12/1872 | Mellor | 83/660 |
| 1,689,047 | 10/1928 | Packer | 30/366 |
| 2,457,277 | 12/1948 | Schlumberger | 166/55.1 |
| 2,580,146 | 12/1951 | Williams | 83/697 |
| 2,594,654 | 4/1952 | Jobe | 166/55.3 |
| 2,653,664 | 9/1953 | Dolby | 72/325 |
| 3,162,211 | 12/1964 | Barusch | 72/325 |
| 3,554,217 | 1/1971 | Ehrens et al. | 137/318 |
| 3,714,959 | 2/1973 | Pignataro, Jr. | 137/318 |
| 3,930,286 | 1/1976 | McGowen | 222/83 |
| 4,497,351 | 2/1985 | Garcia | 222/81 |

FOREIGN PATENT DOCUMENTS

| | | | |
|---|---|---|---|
| 2824601 | 12/1979 | Fed. Rep. of Germany | 222/81 |

*Primary Examiner*—Daniel C. Crane
*Attorney, Agent, or Firm*—Mason, Fenwick & Lawrence

[57] ABSTRACT

A well casing penetrator includes an elongated housing enclosing an outwardly movable hydraulic driven punch for cutting an opening in a casing. A high pressure liquid jet nozzle is mounted on the end of a hose which moves outwardly through an axial bore in the punch when extended through the casing to cut a radially extending opening in the surrounding earth. The punch includes longitudinal slots along opposite sides which cause tabs to be bent back along opposite sides of the opening cut in the casing to prevent dislodging of any portion of the casing from the casing as a consequence of the operation of the punch.

17 Claims, 12 Drawing Sheets

122
86
108
128
160
130
164
162
132
134
136
38
86
166
144
141
138
142
141
140
140
12
148
150
12
174
166
170
86
122
172
86

86
170
172
122
180
178
184
12
176
176
182
184
12
172
170
191
190
186
196
188
192
194

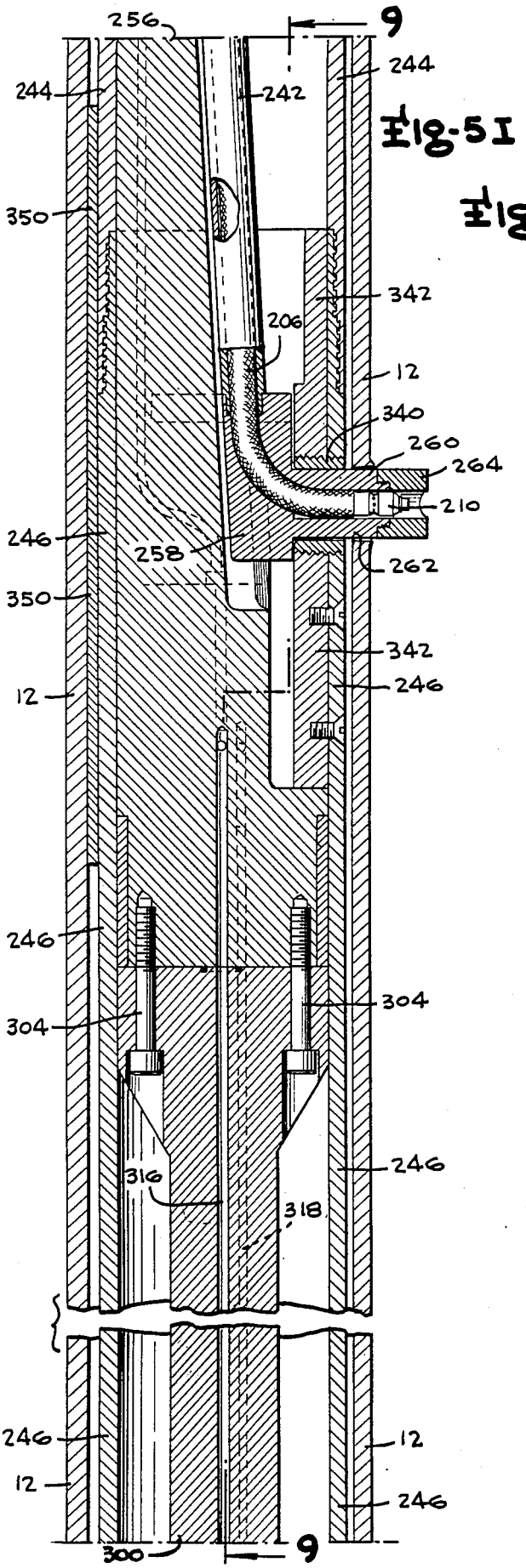
Fig-5I
Fig-5J
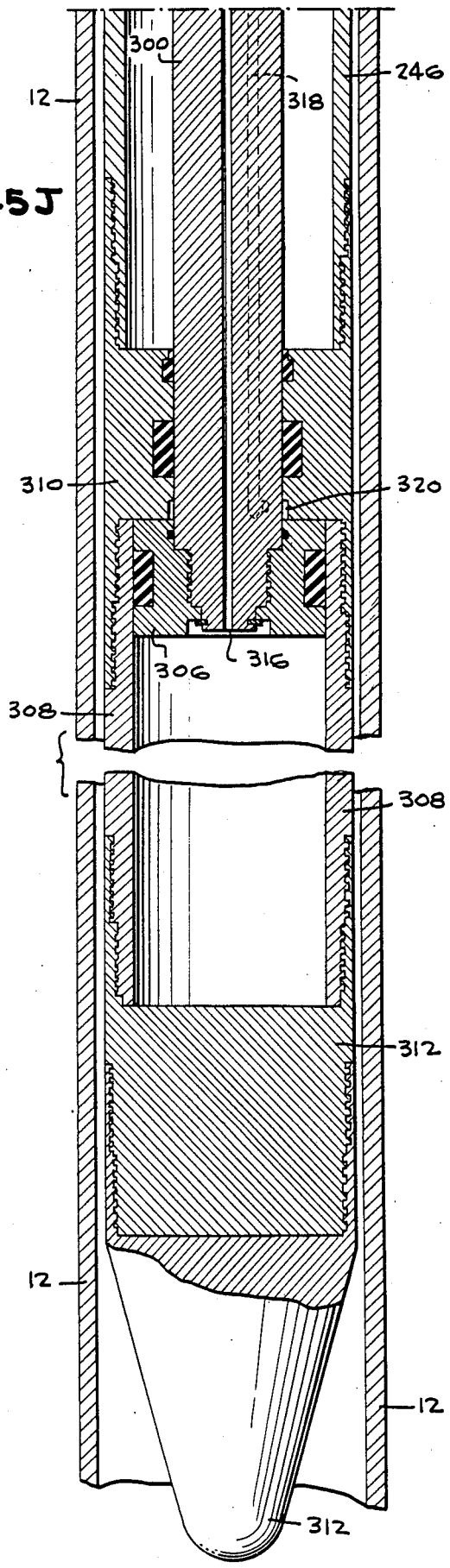

254
252
250
292
290
270
268
282
280
256
274
293
272
294
258
262
353
264
360
353
354
360
184
256
258
185
270
282
257
304
316
318
304
302
300

WELL PENETRATION APPARATUS

This application is a division of application Ser. No. 721,848, filed Apr. 9, 1985, now U.S. Pat. No. 4,640,362.

BACKGROUND OF THE INVENTION

The present invention is in the field of oil and/or gas well casing perforation apparatus, procedures and methods. More specifically, the present invention is directed to a unique apparatus and method employing high pressure fluid driven punch for cutting and opening in a well casing and subsequently cutting a passageway through the surrounding earth by the use of high pressure jets for a substantial distance outwardly beyond the casing for permitting the flow of liquid or gaseous hydrocarbons into the casing.

The vast majority of oil and gas wells are drilled by the use of rotary drilling procedures in which drilling mud containing extremely fine particles is forced downwardly through the drilling string and out through the bit for the removal of cuttings, cooling and other beneficial results. The most commonly employed material in drilling mud comprises extremely small particles of barite. It has been found that the earth surrounding a drill bore is contaminated outwardly by the drilling fluid for a distance of between 18 inches and 4 feet beyond the bore. This contamination, being largely formed of minute particles from the mud, frequently presents a substantial barrier to the inflow of hydrocarbons to the well casing.

A number of expedients have been proposed and employed in an effort to provide flow passageways through the surrounding strata for permitting and increasing the flow of hydrocarbons into the well casing. Probably the most common expedient is the use of projectiles fired from gun-like devices positioned in the casing; however, the projectiles from such devices are normally incapable of penetrating beyond the zone of contamination and optimum flow conditions consequently cannot normally be achieved by the sue of such devices. Consequently, a variety of other proposals for penetrating the surrounding strata have come forward. For example, U.S. Pat. No. 4,022,279 proposes a method of boring spiral bores a substantial distance outwardly from a well casing for increasing production. However, this patent does not disclose a specific apparatus for effecting the desired spiral bores and it is not certain that such structure actually exits.

U.S. Pat. No. 3,370,887 discloses a fracturing device employing a blow-out plug 11 which is blown radially outwardly through the well casing by high pressure injected into the housing in which the plug is mounted. Dahms, et al. U.S. Pat. Nos. 3,400,980 and 3,402,965 both disclose a tool which is moved downwardly out the lower end of the well casing and from which extendible pipe or hose members move outwardly while discharging high pressure liquid to provide a cavity at the lower end of the well. The device of this patent is employed for the mining of salts. Edmunds, et al. U.S. Pat. No. 3,402,967 discloses a device that is similar in operation to the Dahms, et al. patents.

Malott U.S. Pat. No. 3,547,191 discloses an apparatus that is lowered into a well for the discharge of high pressure liquid through nozzle means 26, 27. The discharge from the nozzle means passes through previously formed openings 35 in the casing.

Messmer U.S. Pat. No. 3,318,395 discloses a tool including a body of solid rocket propellant fuel 34 which is lowered to a desired position in a well. The rocket fuel is ignited and the exhaust discharges outwardly through nozzle means 36 to cut through the casing and the cement surrounding the casing. The discharge from the rocket includes abrasive particles which aid in the cutting operation and also serve to cut a notch in the surrounding formation to fracture same and hopefully improve production.

The Tagirov, et al. U.S. Pat. No. 4,050,529 discloses a tool which is lowered down a well casing and includes nozzle means through which high pressure abrasive containing water is pumped to cut through both the casing and the surrounding formation. The use of abrasive materials pollutes the well forever in that it creates monumental wear problems in valves, pumps and the like subsequently used with the well. The abrasive is absorbed in the surrounding formation and also blocks the pores of the formation.

Skinner, et al. U.S. Pat. No. 4,346,761 discloses a system including nozzles 20 mounted for vertical up and down movement in the casing to cut slots through the casing. The nozzle means does not protrude beyond the casing; however, the high pressure jet discharged from the nozzle would apparently effect some cutting of the surrounding strata.

Other patents disclosing high pressure nozzles for cutting well casings include Brown, et al. U.S. Pat. No. 3,130,786; Pitman U.S. Pat. No. 3,145,776 and Love, et al. U.S. Pat. No. 4,134,453. Archibald U.S. Pat. No. Re. 29,021 discloses an underground mining system employing a radial jet which remains in the well bore for cutting the surrounding formation. Summers U.S. Pat. No. 4,317,492 discloses a high pressure water jet type well system usable in mining and drilling operations in which a nozzle providing a jet is moved out the bottom of the well and is then moved radially. Jacoby U.S. Pat. No. 3,873,156 also discloses a jet-type mining device movable out the lower end of a well for forming a cavity in a salt well. Boyadjieff U.S. Pat. No. 4,365,676 discloses a mechanical drilling apparatus moveable radially from a well for effecting a lateral bore hole. A number of additional U.S. patent disclose the employment of high pressure nozzle means for cutting the strata adjacent or at the bottom of a well with these patent including U.S. Pat. Nos. 2,018,285; 2,258,001; 2,271,005; 2,345,816; 2,707,616; 2,758,653; 2,796,129 and 2,838,117.

None of the prior art devices have achieved any substantial degree of success due to a variety of shortcomings. For example, those devices which simply project a high pressure jet from a nozzle positioned inside the casing cannot cut outwardly from the casing a sufficient distance to be truly effective. Moreover, the direction and extend of the cut provided by such devices is subject to a number of variable parameters including the nature of the surrounding formation and it is therefore difficult to achieve a predicable result. One problem with all high pressure type jet devices operating through the wall of the well casing is that an aperture must be cut in the casing and the surrounding cement as a prerequisite to cutting through the surrounding formation. In some of the prior known devices the aperture can be cut with the nozzle jet itself whereas other devices require the use of separate mechanical cutting means. Those devices using nozzle jets for cutting through the casing suffer from a very serious drawback in that the cutting liquid frequently includes abrasive particles which remain in the casing and can subsequently adversely effect valves or other components such as pumps or the like through which the abrasive components eventually move.

The use of separate mechanical cutting devices suffers from the shortcoming of requiring substantial additional expense both in terms of the cost of the extra equipment and the cost of time required in using same for cutting the casing. This is true because such use will normally require lowering of the cutting device to the bottom of the well, cutting of the casing and subsequent removal of the cutting device and positioning of the jet means in the casing prior to usage of the nozzle jet-type cutter. The positioning and removal of tools from the well normal requires a time consuming and expensive pulling and replacement of the string.

A common shortcoming of all types of penetrators is that they simply do not result in adequate penetration of the formation outwardly of the casing a sufficient distance to achieve improved production. Therefore, there has been a very substantial need for apparatus capable of effectively penetrating the earth formation surrounding a well casing for a distance outwardly beyond the casing outside the contamination zone surrounding the casing.

It is consequently the primary object of the present invention to provide a new and improved apparatus and method for penetrating earth formations around a well casing.

SUMMARY OF THE INVENTION

Brief Description of the Drawings

FIGS. 5B, 5C, 5D, 5E, 5F, 5G, 5H, 5I and 5J are all sectional view taken along lines 5—5 of FIG. 3 respectively illustrating portions of the preferred embodiment in successive order downwardly beneath the filter assembly of FIG. 5A;

DESCRIPTION OF THE PREFERRED EMBODIMENT

Figures 1, 1A, 2:
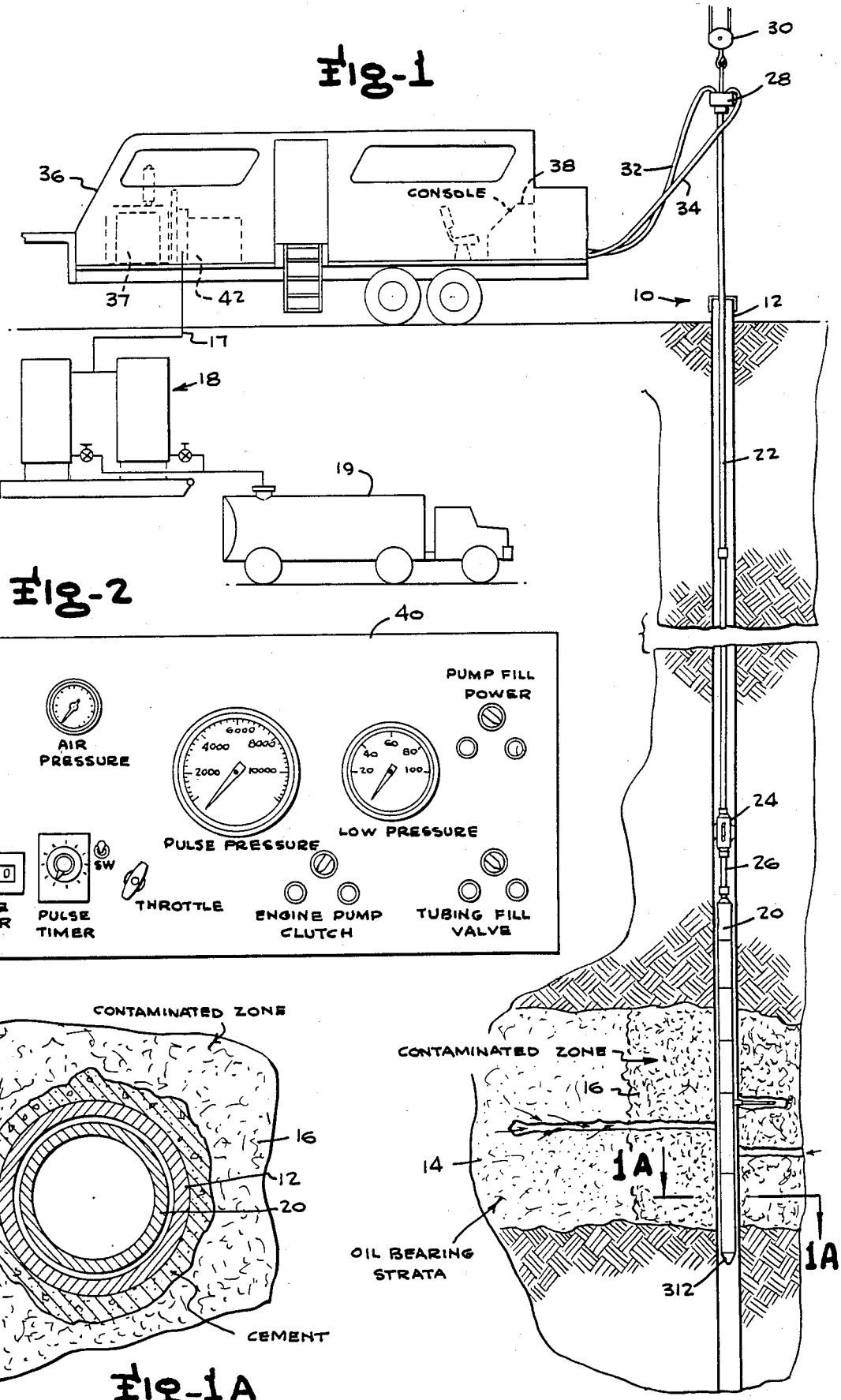
FIG. 1 is a side elevation view illustrating a gas or oil well in section and the surface equipment and downhole apparatus of the present invention being used in perforating the well.
FIG. 1A is a section view taken along lines A—A of FIG. 1.
FIG. 2 illustrates the control panel by means of which the present invention is monitored and controlled during use.

Attention is initially invited to FIG. 1 of the drawings which illustrate the employment of the preferred embodiment of the invention in an oil well 10 having a casing 12 extending downwardly through an oil bearing strata 14. A contaminated zone 16 extends outwardly around the casing and comprises drilling mud constituents forced into the oil bearing strata during the drilling operation. Additionally, the area immediately surrounding the casing will normally include a concrete blanket put into position at the completion of the well.

The present invention comprises an elongated downhole apparatus 20 suspended from the surface by a pipe string 22 comprising a plurality of conventional tubular pipe sections with the lowermost pipe section being connected to a stabilizer/anchor 24 of conventional construction which includes selectively operable means expandable outwardly for engagement with the inner wall of casing 12 to anchor the stabilizer/anchor in fixed position. The upper end of elongated apparatus 20 is supported from stabilizer/anchor 24 by a short tubing section 26.

The upper end of the string 22 includes a swivel 28 supported by conventional means 30 on a workover rig (not shown) or the like and connected to a low pressure hose 32 and a high pressure hose 34 to sources of pressurized fluid. Hose members 32 and 24 extend from a vehicle in the form of trailer 36 in which a control console 38 having a control panel 40 is mounted. Additionally, trailer 36 includes a motor 37 driving conventional high pressure and low pressure pump means connected to the hose member 32 and 34 and controlled from the console control panel 40. The pumps receive working fluid from a suction line 17 extending from a conventional two-stage element filter assembly 18 which receives the unfiltered working fluid from a tank truck 19 and filters out all particles greater than 50 microns in size. The high pressure pump is a five piston positive displacement pump which provides a pulsating output the frequency of which can be adjusted.

Figure 3:
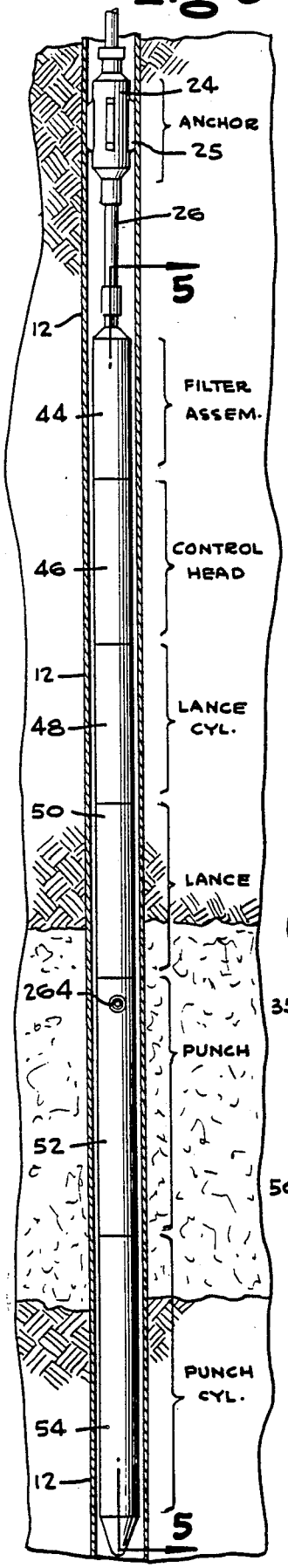
FIG. 3 is a section of the earth illustrating a portion of an oil well in which the preferred embodiment of the invention is positioned with the preferred embodiment being in an unactivated condition.

The elongated downhole apparatus 20 is formed of a plurality of connected tubular housing members in which various functions and equipment are provided. The housing function providing sections from top to bottom as illustrated in FIG. 3 comprise a filter function section 44, a control function section 46, a lance cylinder section 48, a lance section 50, a punch section 52 and a punch cylinder section 54.

Figure 5A:
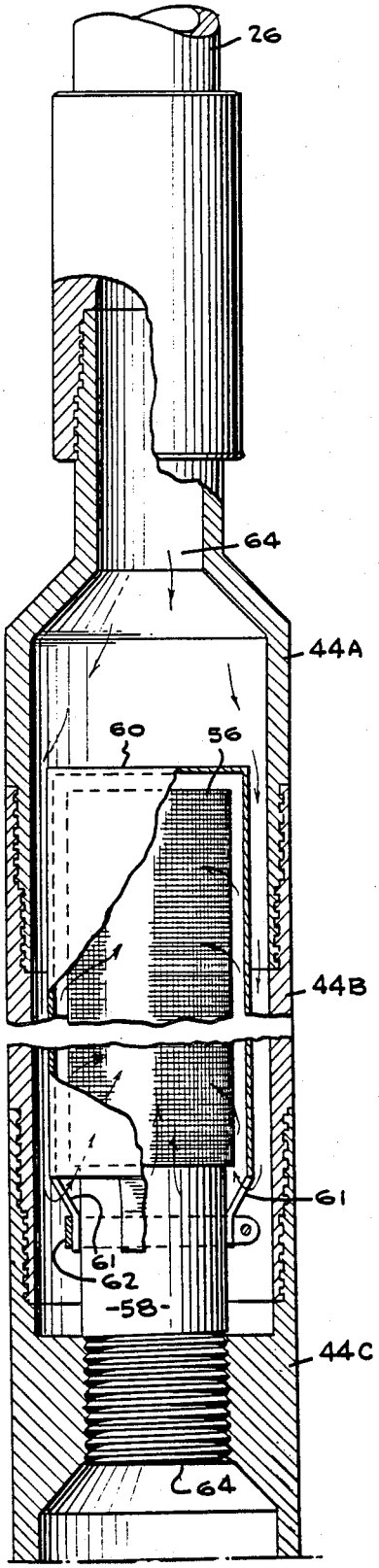
FIG. 5A is a sectional view of the upper end of the preferred embodiment taken along lines 5—5 of FIG. 3.

Filter section 44 includes an upper portion 44A, an intermediate portion 44B and a lower portion 44C. Upper portion 44A and lower portion 44C are threadably connected to the intermediate portion 44B as best shown in FIG. 5A. A cylindrical filter 56 is mounted in upper portion 44A on a support sleeve 58 and filters out particles greater than 100 microns in size which have gotten into the working fluid from the drill string and other equipment downstream filter assembly 18. A protective shield 60 covers the upper end of the filter member 56 and has lower spaced parallel leg members 61 clamped to support sleeve 58 by means of a conventional clamp member 62. Working fluid for the apparatus will normally be either diesel fuel or brine. In any event, the working fluid is pumped down the string and enters the filter section through upper inlet port 64 from which the power fluid flows downwardly and then upwardly and inwardly through the cylindrical filter member 56 into the interior of support sleeve 58 from which it is discharged downwardly through a lower discharge opening 64 from which it flows into the control head housing 46.

Figure 5B:
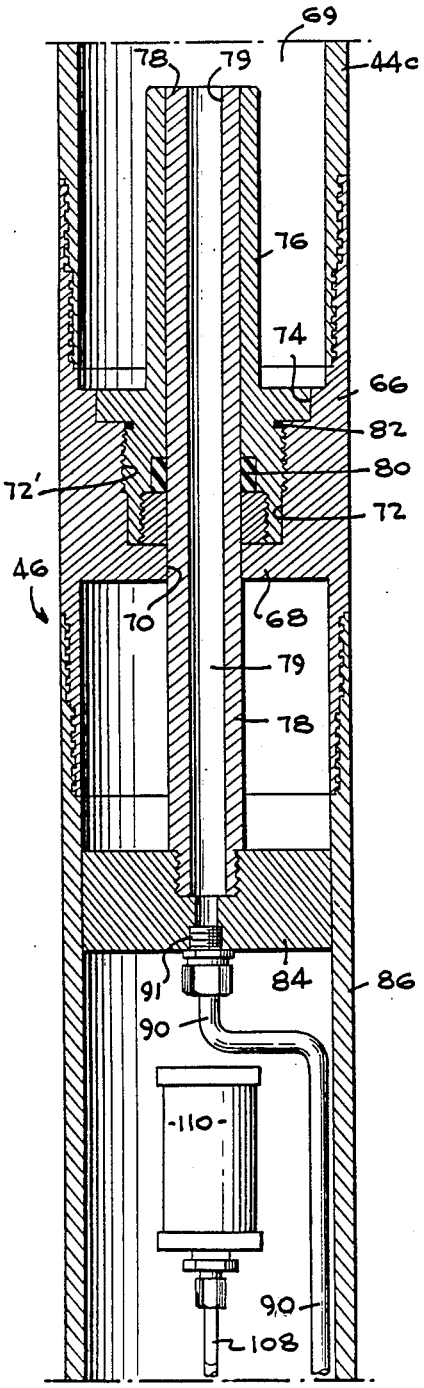

The lower end of lower housing portion 46C is threadably connected to a tubular coupling member 66 (FIG. 5B) which includes a relatively thick internal wall 68 including a small diameter bore portion 70 at its lower end, a larger diameter central bore portion 72 having a threaded upper end and an even larger bore 74 at its upper end. A threaded sleeve 76 is threadably mounted on the threads of the threaded bore portion 72' and a high pressure conduit 78 extends through sleeve 76. Seal means 80 and 82 ensure that any liquid passing through the wall 68 will flow through the internal passage 79 of the high pressure conduit 78.

Figure 5C:
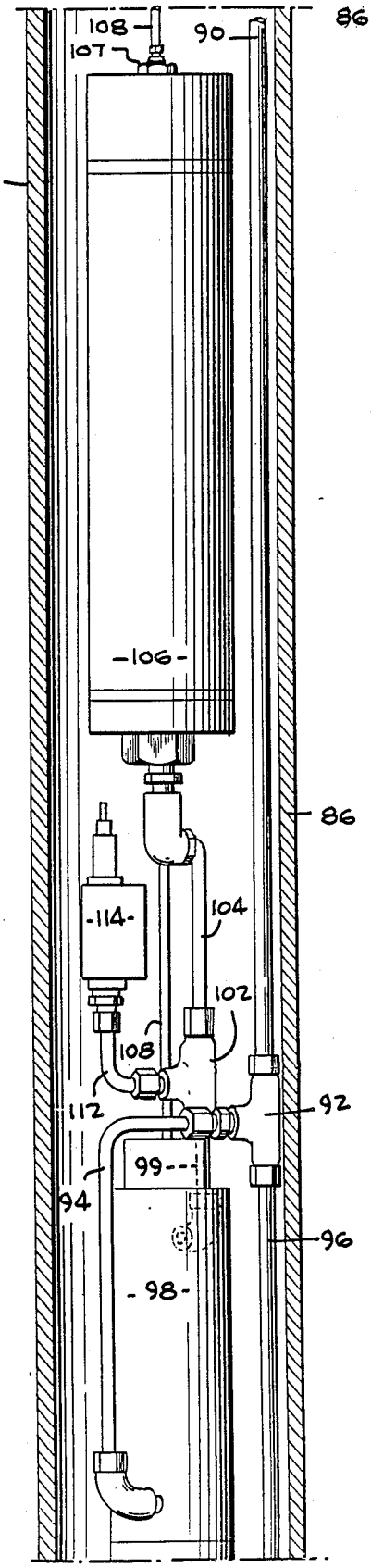
Figures 18A, 18B:
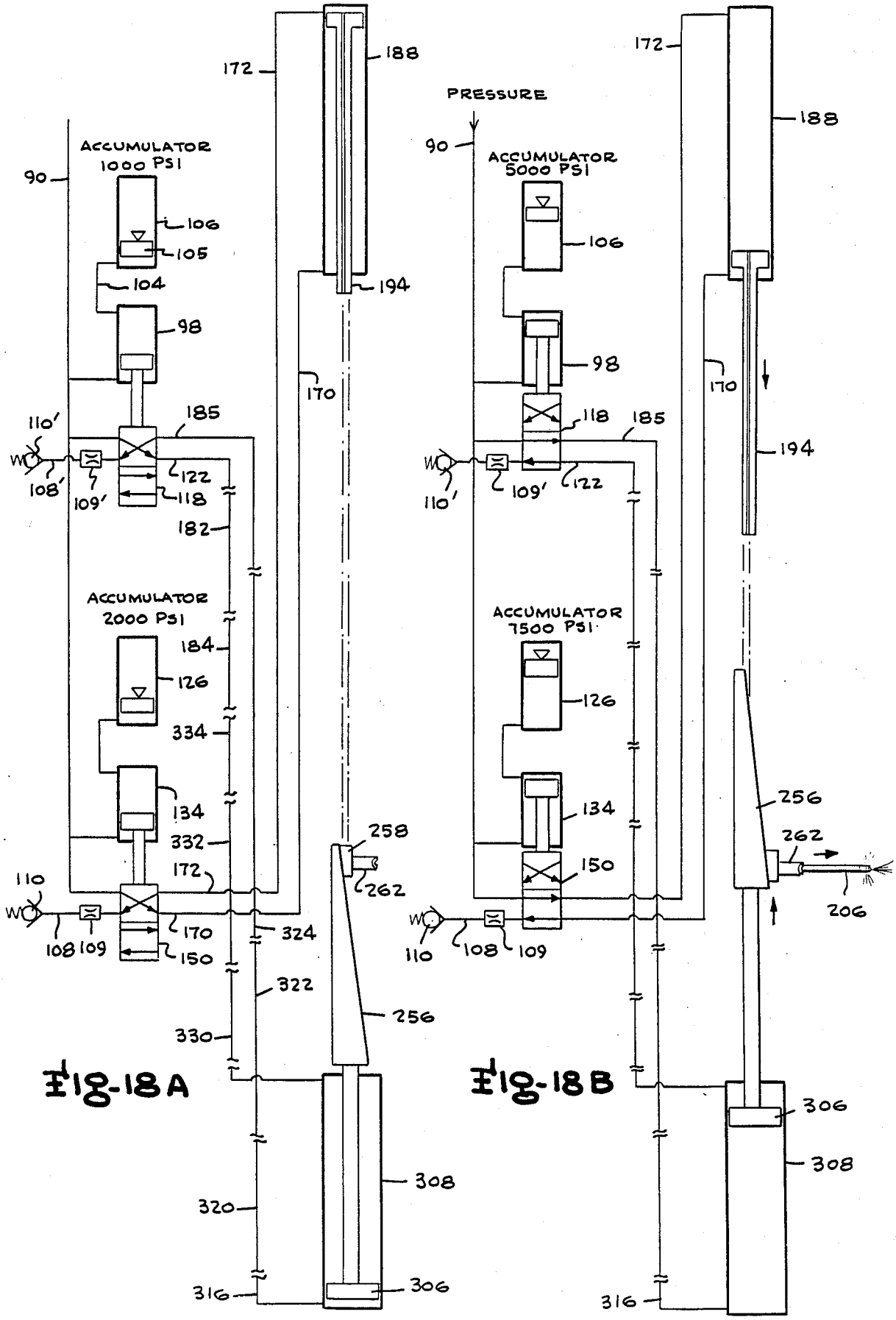
FIG. 18A is a hydraulic/mechanical schematic illustrating the position of the power components of the preferred embodiment prior to initiation of a casing punching operation.
FIG. 18B is a hydraulic schematic similar to FIG. 18A but illustrating the position of the parts following the punching of an aperture through the well casing.

The lower end of the high pressure conduit 78 is threadably received in a transverse wall 84 of a fifth tubular housing component 86 which has its upper end threaded onto the lower end of the coupling member 66. A one-way check valve 110 is mounted below transverse wall 84 and is connected to the upper end of exhaust line 108 which includes a flow restriction means 109 and passes behind accumulator 106, cylinder 98, etc. and has its lower end connected to a rotary control valve 150 (FIGS. 5E and 18A). A second high pressure conduit 90 is connected to a fitting 91 provided in the transverse wall 84 so as to communicate with first high pressure conduit 78. The lower end of second high pressure conduit 90 is connected to a Tee-member 92 (FIG. 5C) from which third and fourth high pressure lines 94 and 96 extend.

Figure 5D:
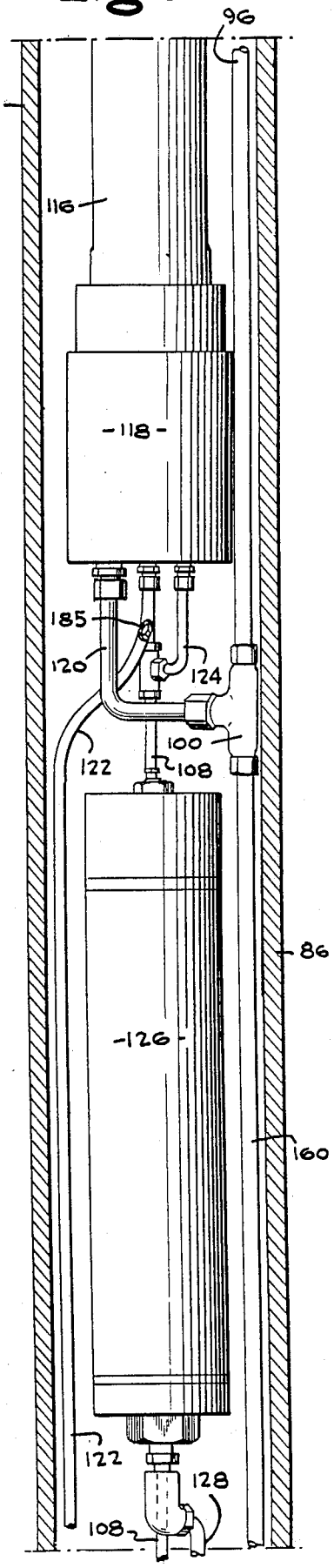
Figure 5E:
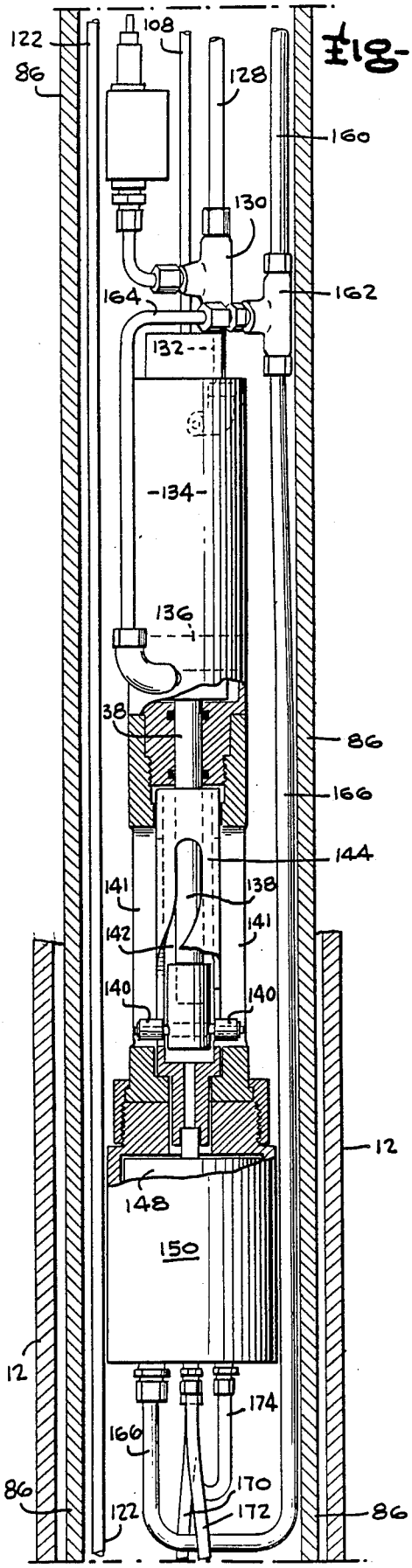

Line 94 is connected to the lower end of a punch initiate or valve drive cylinder 98 and the lower end of the fourth high pressure line 96 is connected to a second Tee-member 100 (FIG. 5D). The upper, or head, end of cylinder 98 is connected by line 99 to a third Tee-member 102 which is in turn connected by a line 104 to the lower end of a conventional low pressure accumulator 106 which comprises an upper pressurized gas chamber and a lower oil chamber separated by a floating piston 105 (FIG. 18A). The upper end of low pressure accumulator 106 is is provided with a fitting 107 at its upper end which permits its upper chamber above piston 105 (FIG. 18A) to be pressurized to a desired set pressure of 1,000 psi at the well surface. The lower chamber is then pressurized with out at 1,500 psi so that the piston 105 assumes a central position in the accumulator and the pressure of the nitrogen stabilizes with that of the oil. Also, the third Tee-member 102 is connected by a line 112 to a metering valve 114 which is used to initially fill lines 104 and 112 and the upper end of cylinder 98 with working fluid in the form of diesel fuel prior to the lowering of the assembly down the well.

Valve drive cylinder 98 actuates a linear to rotary movement converter 116 which in turn serves to actuate a conventional rotary valve 118 into one of two possible positions. Rotary valve 118 has a high pressure inlet connected by line 120 to the second Tee-member 100 and is also connected to lines 185, 122 and 124. An exhaust line 108' which includes a flow resistor 109' and check valve 110' is also connected to valve 118 as shown in FIG. 18A. A high pressure accumulator 126, which is identical to low pressure accumulator 106 except for the act that it is pressurized at the well head in its upper chamber with nitrogen at 2,000 psi, is positioned beneath rotary valve 118 and has a line 128 connected to its lower end and extending downwardly to a fourth Tee-member 130 (FIG. 5E). Accumulator 126 includes a piston 127 separating its upper gas chamber with a lower oil chamber which is pressurized to 2,400 psi to generally center piston 127 and increase the nitrogen pressure to the same value. A line 132 extends downwardly from Tee-member 130 for connection to the upper end of a second valve drive or cutting initiate cylinder 134. The pressure in the string and the accumulators can be adjusted or set at will in order to accommodate different well conditions.

Valve drive cylinder 134 includes a piston 136 having a rod 138 with rollers 140 mounted on the outer end of the rod and engageable with linear guide surfaces 141 and also engages a slot 142 in a follower 144. Since piston rod 138 is restrained against rotation about its axis due to the coaction of rollers 140 and guide surfaces 141, axial reciprocation of the rod 138 serves to effect rotation of the follower 144 as a consequence of reaction forces between elements 144 and 142. Since follower 144 is attached to the upper end of a rotary spool 148 of a second rotary valve 150, actuation of the piston 136 consequently results in rotation of the valve spool to a selected one of two possible positions to control fluid flow through the valve. It should also be noted that the first valve drive cycle 98 and its associated first rotary valve 118 are identical in construction to the cylinder and valve means 134, 150, etc. as just described.

A pressure line 160 extends downwardly from the second Tee-member 100 (FIG. 5D) and is connected on its lower end to a fifth Tee-member 162 which is illustrated in FIG. 5E. Line 164 extends from the fifth Tee-member 162 and is connected to the lower end of the second valve drive cylinder 134. Pressure line 166 extends downwardly from fifth Tee-member 162 and is connected to an inlet port on the second rotary valve member 150. Lines 170 and 172 are also connected to valve 150 as is line 174.

Figure 5F:
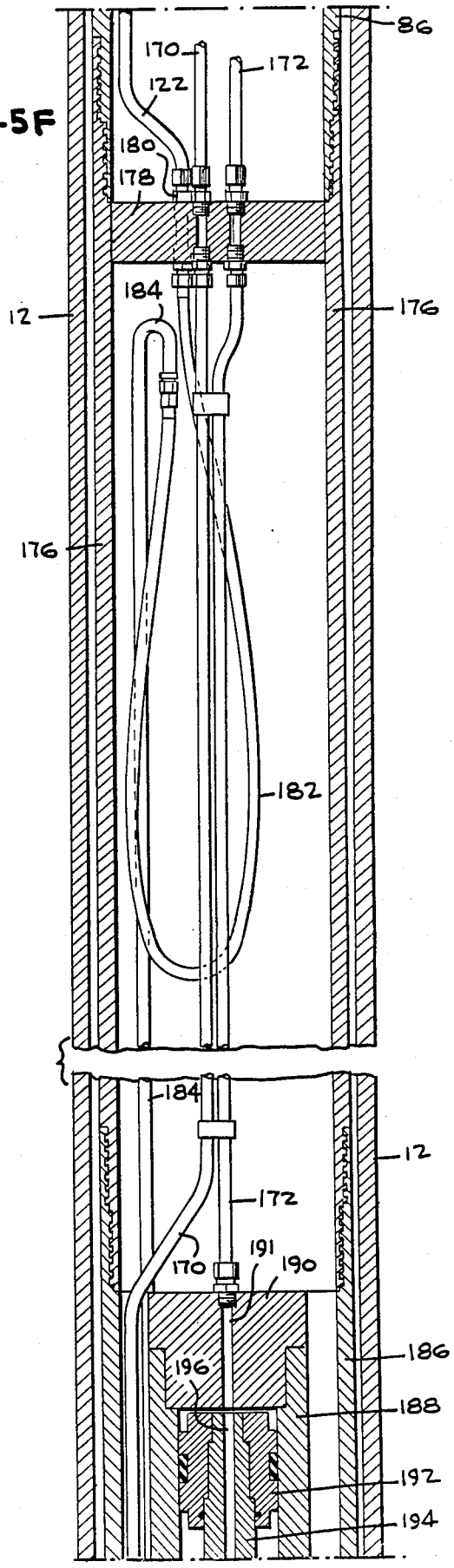
Figure 13:
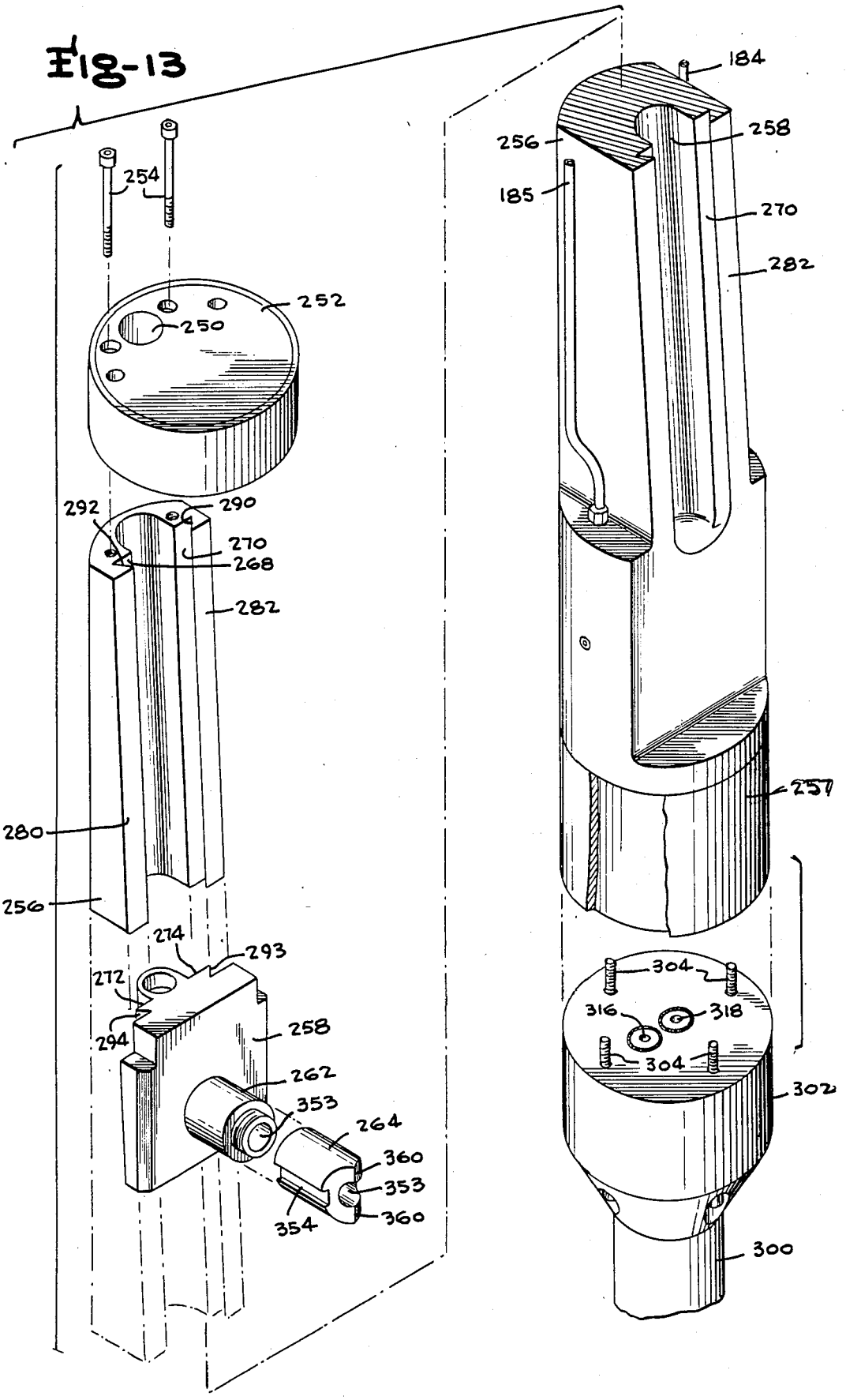
FIG. 13 is an exploded perspective view of punch drive means employed for actuating the casing punch means for cutting an aperture in the well casing.
Figure 14:
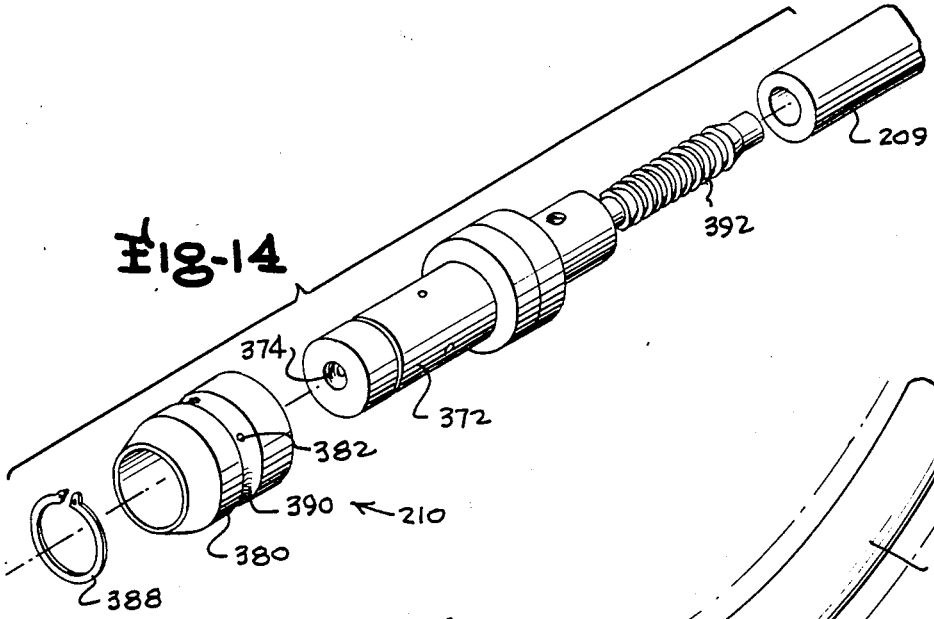
FIG. 14 is an exploded perspective view of nozzle means employed in the preferred embodiment.
Figure 15:
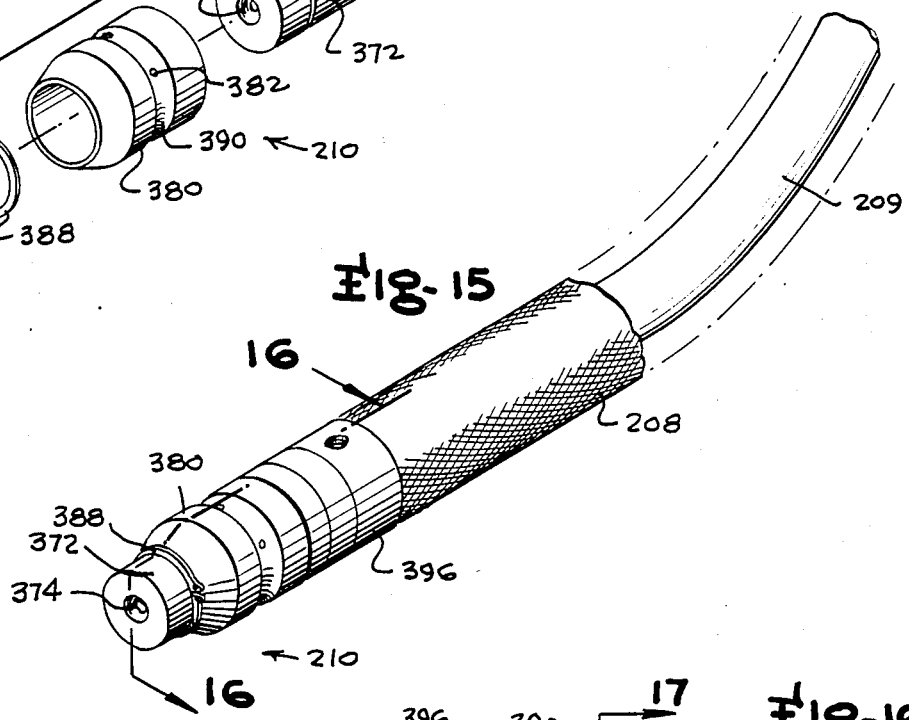
FIG. 15 is a perspective view of the assembled nozzle means of FIG. 14.

The lower end of the fifth tubular housing component 86 is threadably coupled to the upper end of a sixth tubular housing component 176 as shown in FIG. 5F. A transverse interior wall 178 is provided in the upper end of the sixth tubular housing component 176 and includes a fitting 180 connected to the lower end of line 122 above the transverse interior wall 178 and connected to the upper end of a flexible high pressure hose 182. The opposite end of the high pressure holes 182 is connected to a conduit 184 which is connected at its lower end to the base 257 of a movable arm 256 (FIG. 13).

Figure 5G:
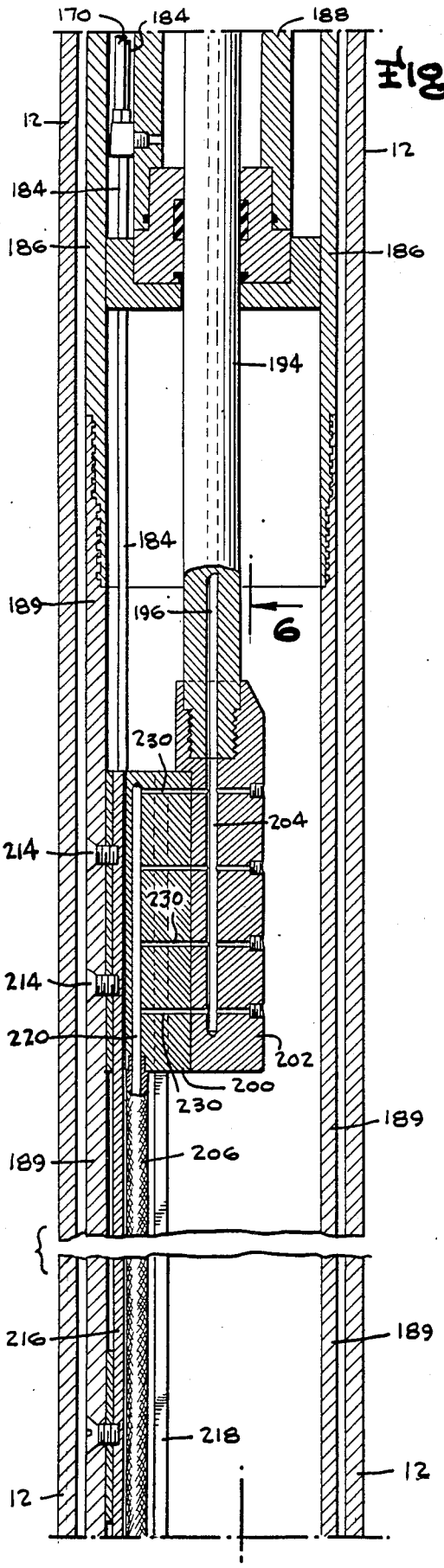

Lines 170 and 172 extend downwardly from rotary valve 150 and are connected to fittings extending through the transverse interior wall 178. The lower end of the sixth tubular housing component 176 is threadably connected to the upper end of a seventh tubular housing component 186 in which a nozzle drive cylinder 188 is mounted. The lower end of tubular housing component 186 is connected to the upper end of an eighth tubular housing component 189. Hose extend-retract drive cylinder 188 is mounted in housing component 186 and includes a cylinder head 190 to which the lower end of line 172 is connected to communicate with bore 191 as shown in FIG. 5F. Line 170 is connected to the rod end of cylinder 188 as shown in FIG. 5G. A piston 192 is mounted on a piston rod 194 which includes an axial passageway 196 extending all the way through the piston 192 as clearly shown in FIG. 5F. It will be observed that the axial passageway 196 of the rod 194 is connected at its lower end to a passageway 204 in a coupling block 202. Conduit 184 extends downwardly behind cylinder 188.

Figure 8:
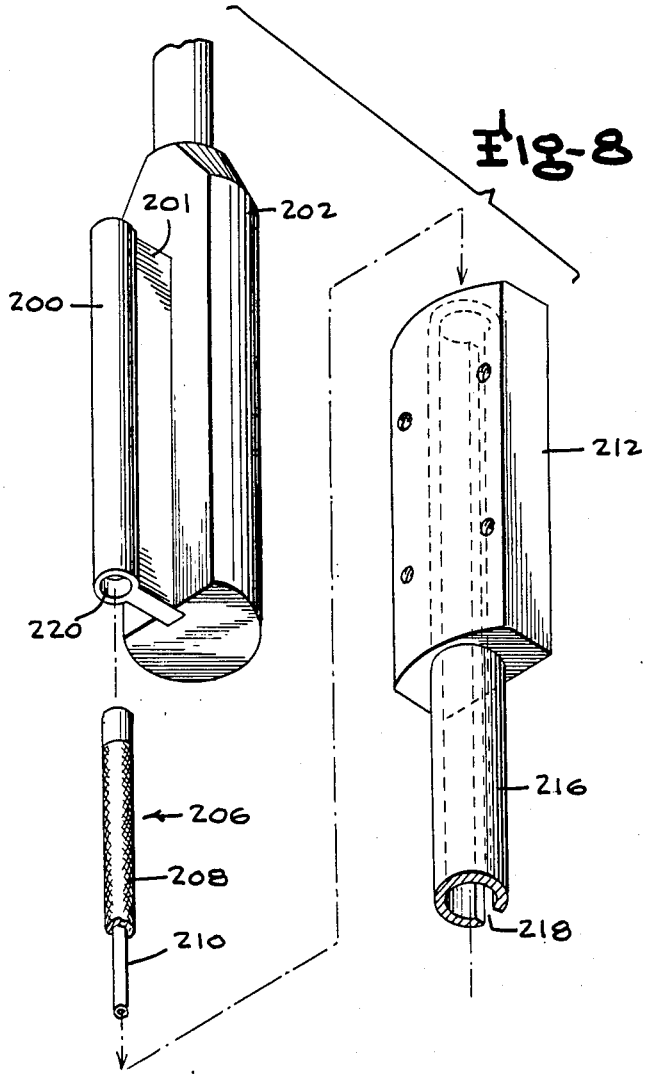
FIG. 8 is an exploded perspective view of a portion of high pressure hose feed means employed in the preferred embodiment.
Figure 16:
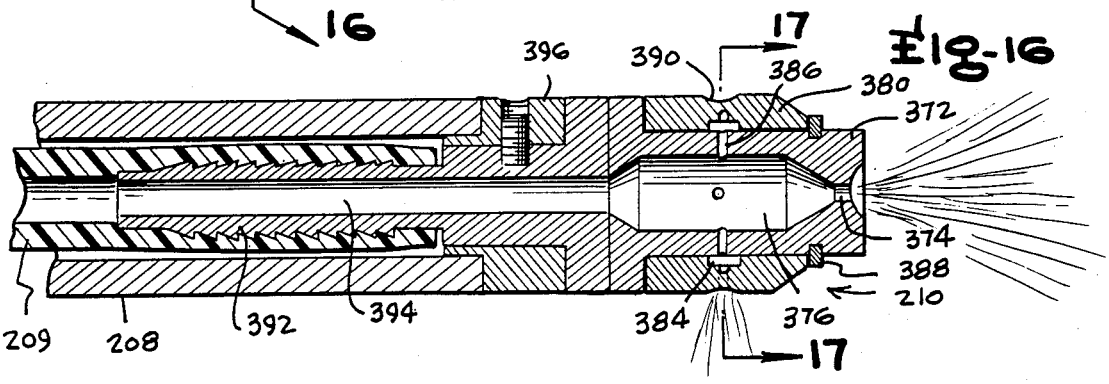
FIG. 16 is a sectional view taken along lines 16—16 of FIG. 15.
Figure 17:
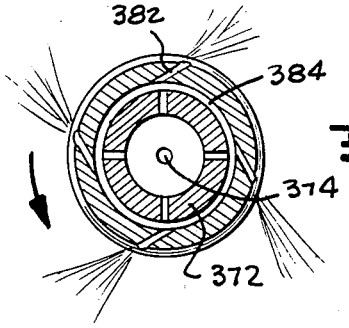
FIG. 17 is a sectional view taken along lines 17—17 of FIG. 16.

A flexible composite nozzle hose 206 comprising an outer flexible spiral stainless steel mesh sheath 208 and an inner high pressure plastic tube 209 formed of KEVLAR (a trademark of E. I. du Pont & Co.) is connected to the movable carriage block 200 to be reciprocated thereby. It should be observed that the opposite or outer end of the hose 206 provides support for jet nozzle means 210 illustrated in FIG. 16. In any event, the movable carriage block 200 is positioned in a slotted metal guide tube 216 mounted in a slotted anchor block 212 (FIG. 8) which is fixedly connected to the eleventh tubular housing component 186 by machine grooves or the like 214. The downwardly extending slotted metal guide tube 216 has its upper end mounted in the anchor block 212 and has a longitudinally extending slot 218 extending along its entire length with slot 218 being of sufficient width to permit the neck portion 201 of movable carriage block 200 to be received therein and moved along the length of the slot. The slot 218 is of sufficient length to permit movable carriage block 200 to move a distance equal to the stroke of piston rod 194.

A bore 220 in moveable carriage block 200 is closed at its upper end and is connected at its lower end to the high pressure hose member 206 and is in communication with bore 204 by means of plural connecting bores 230 as shown in FIG. 5G. Cutting fluid for the nozzle jet 210 is delivered via axial bore 196, bore 204, outer bores 230 and 220 for a purpose to be discussed in greater detail hereinafter. The lower end of guide tube 216 terminates at a transverse wall 232 provided in the upper end of a eighth tubular housing component 234 with hose 206 extending through an opening 236 in wall 232. It should be observed that first and second guide tube retainer blocks 222 and 224 are attached to the inner wall of the seventh tubular housing component 186 for holding the lower end of guide tube 216 in fixed position relative to the housing. The eighth tubular housing component 234 is threadably connected at its upper end to the lower end of the seventh tubular housing component 186. The lower end of the eighth tubular housing component 234 is threadably connected to a ninth tubular housing component 244.

Figure 5H:
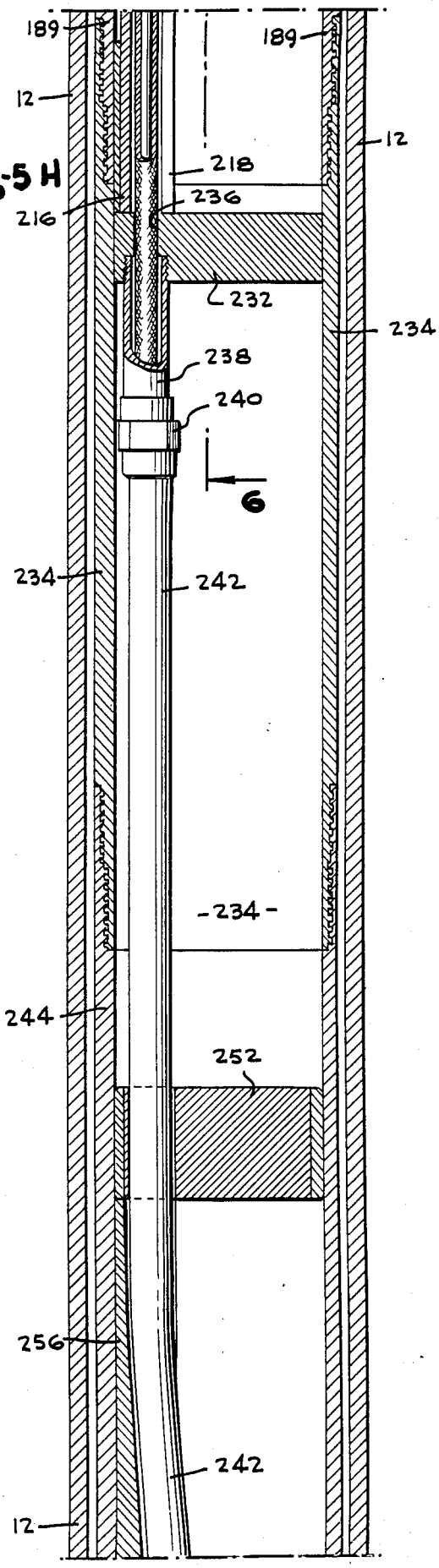
Figure 6:
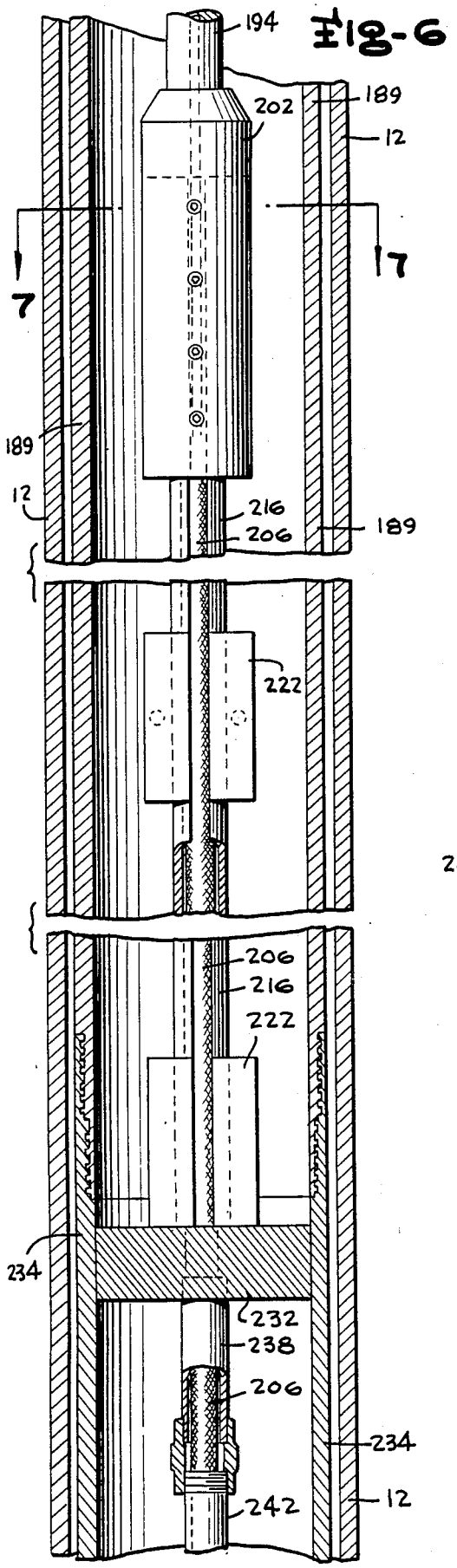
FIG. 6 is a sectional view taken along lines 6—6 of FIGS. 5G and 5H.
Figure 7:
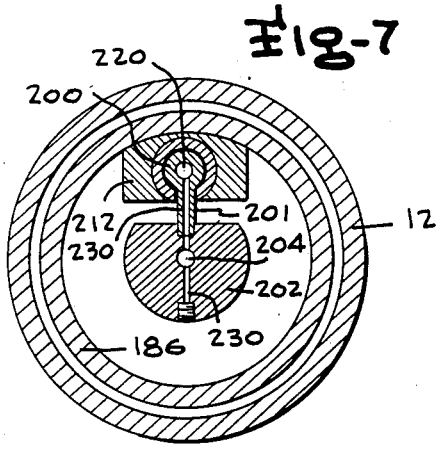
FIG. 7 is a sectional view taken along lines 7—7 of FIG. 6.

A second guide tube 238 extends downwardly from opening 236 and is connected by coupling 240 to a third guide tube 242 as best shown in FIG. 5H. Nozzle hose 206 extends downwardly through guide tubes 238 and 242 for axial movement therein.

The lower end of the third guide tube 242 passes through an aperture 250 of a guide disc 252 (FIG. 13) connected by machine screws 254 to the upper end of a punch drive cam 256 having base 257 and a centrally located and longitudinally extending tube receiving groove 258 in which tube 242 is positioned. The lower end of tube 242 is connected to a cam follower base 258 of a punch member 260 which includes an inner threaded stub 262 and an outer removable tip 264.

Figure 10:
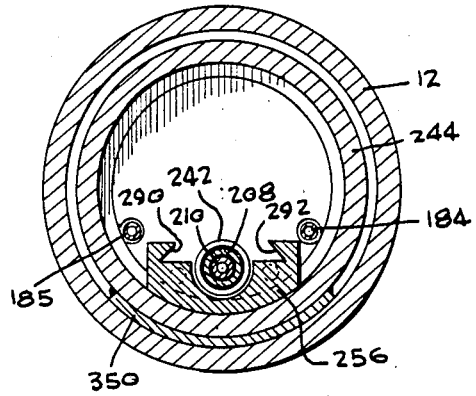
FIG. 10 is a sectional view taken along lines 10—10 of FIG. 9.
Figure 11:
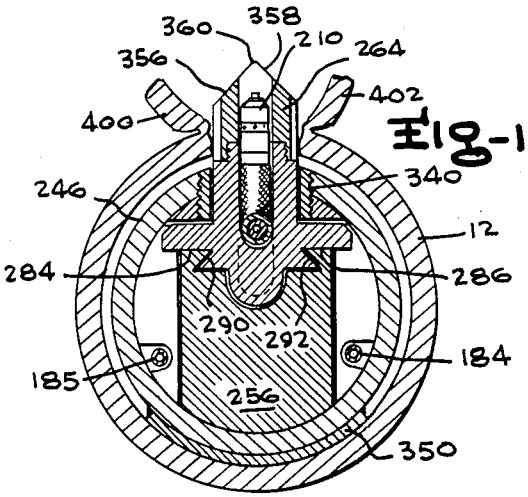
FIG. 11 is a sectional view taken along lines 11—11 of FIG. 9 and illustrating the casing punch in its extended position following the completion of the punching of a hole in the casing.
Figure 12:
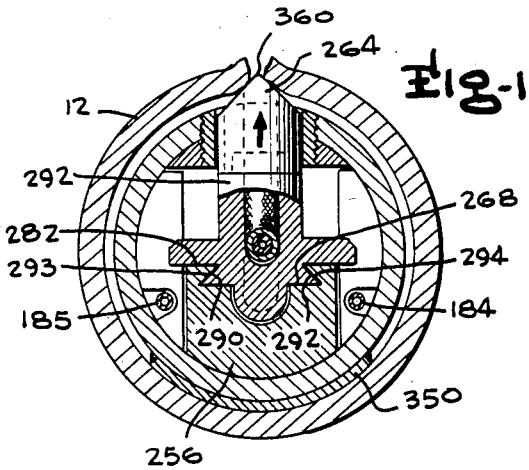
FIG. 12 is a sectional view similar to FIG. 11 but illustrating the parts in a position at the beginning of a casing punching operation.

First and second punch extend planar camming surfaces 268 and 270 are provided in a common plane on the punch drive cam 256 and respectively engage planar follower surfaces 272 and 274 of base end 258 of the casing punch means. Additionally, a second pair of punch extend drive cam surfaces 280, 282 are also provided on the punch drive cam 256 and drivingly engage mating corresponding planar surfaces 284 and 286 of the base end 258 of the camming punch means 260. Consequently, upward movement of punch drive cam 256 serves to move the punch means 258, 262, 264 outwardly to effect a punching operation. Conversely, downward movement of cam 256 dove tail camming surfaces 290, 292, on cam 256 as best shown in FIGS. 10, 11 and 12, to react with contiguous planar surfaces 293, 294 of the base end 258 of the camming punch means 260 to retract the punch member.

Movement of the punch drive cam 256 in an upward direction is effected by movement of a piston rod 300 having a coupling head 302 connected by machine screws 304 to the base end 257 of punch drive cam 256. The lower end of rod 300 is connected to a piston 306 in a cylinder member 208 having a head 310 threadably connected to its upper end. Additionally, head 310 further includes a threaded sleeve at its upper end threadably connected with the lower end of a tenth tubular housing component 246 which is in turn threaded at its upper end to the lower end of the ninth tubular housing component 244. Cylinder head 312 closes off the lower end of cylinder 308 with a protective tip member 314 being attached to the lower end of head 312 and constituting the lower end extent of the tool member 20.

Figure 9:
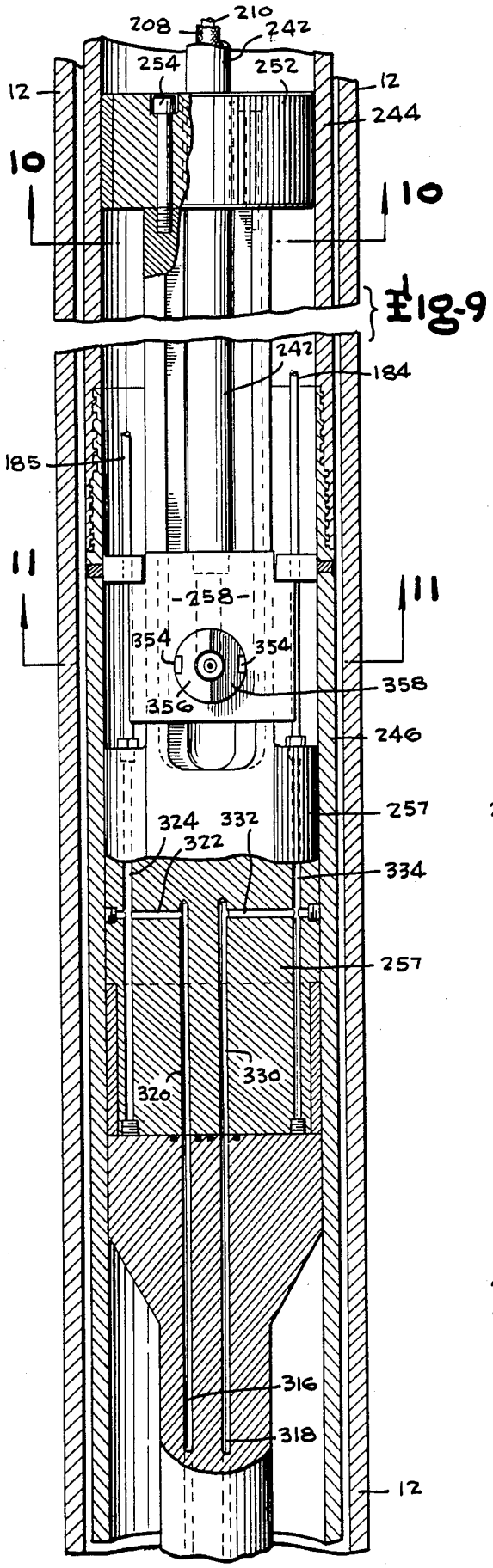
FIG. 9 is a sectional view taken along lines 9—9 of FIG. 5I.

An axial bore 316 extends the length of rod 300 and communicates with the head end of cylinder 308 as shown in in FIG. 5J. Additionally, rod 300 includes a second bore 318 communicating at its lower end with an annular chamber 320 provided in the head 310 as best shown in FIG. 5J. Bore 316 is connected to conduit 184. The aforementioned connection is effected by bores 320, 322 and 324 provided in the connecting head 257 as shown in FIG. 9. Similarly, bore 318 is connected to conduit 184 by bores 330, 332, and 334.

Casing punch means 260 is positioned in a guide sleeve 340 mounted in the tubular housing component 246 and oriented radially with respect thereto. Additionally, a heavy reinforcing cylinder portion 342 is mounted axially in mating manner inside tubular housing component 246 with the guide sleeve 340 extending therethrough as clearly shown in FIG. 5I. Also, it should be noted that a pillow plate 350 is welded to the exterior surface of the tenth tubular housing component 246 at a location diametrically opposite from the punch member 260. Pillow plate 350 consequently serves to absorb and spread reactive forces resultant from outward movement of the punch member against the casing during a punching operation.

Punch member 260 includes an axial hose passageway 353 (FIG. 13) extending through components 262 and 264 and through which the hose member 206 can be extended or retracted. Also, channel grooves 354 are provided on each side of the punch member constituents 262, 264 for permitting the backwash of cuttings into the casing. The removable outer tip 264 has its outer end defined by first and second planar surfaces 256, 258 which intercept along a line 260 through which the axis of the punch extends.A curved passageway 362 connects the hose positioning bore 353 with the lower end of the third guide tube 242 so as to provide a smooth guideway for the hose member 206. The construction is such as to permit tip 264 to shear from element 262 if subjected to substantial lateral force as might occur if the tip fails to fully retract following a punching operation and upward force is exerted on the tool.

The jet nozzle means 210 comprises a nozzle block 372 having an axial orifice 374 extending from a central chamber 376 and having an outer counter sunk dish-shaped defusion surface 378. A rotary sleeve 380 is mounted for rotation on the outer surface of nozzle block 372 and includes a plurality of canted nozzle jets 382 each of which has an inner end connected to an annular groove 384 which in turn communicates with the central chamber 376 by means of radial passageways 386 in nozzle block 372. Rotary sleeve 380 is retained in position by a retainer clip 388 engaging its outer end. It should also be observed that the outer ends of the canted nozzle jets 382 terminate in an annular dish-shaped defusion groove 390 on the outer surface of the rotary sleeve 380. Nozzle block 372 has an inner portion 392 connected to the inner plastic outer metal hose sheath member 208 so that high pressure liquid therefrom flows through a passageway 394 into the central chamber 376 in an obvious manner. Retainer means 396 maintains the connection between the hose constituents and the nozzle body elements.

A complete cycle of operation will now be described with it being understood that the cycle of operation could be employed for either the initial perforation of a new well or for the reworking of an old well. In either type of operation the procedure is essentially the same. The string and all downhole equipment will be initially pulled from the well and completion fluids will be placed in the well to make certain that all downhole pressure are retained downhole.

The apparatus 20 is prepared for lowering down the well by causing the low pressure accumulator 106 and the high pressure accumulator 126 to be respectively pressurized with 1,000 psi and 2,000 psi. The lower end of accumulator 106 and associated elements 104, 102 and the upper end of first drive cylinder 98 are primed with work fluid at 1,500 psi through valve 114. Similarly, the lower end of high pressure accumulator 126 and the upper end of cylinder 134 is primed at 2,400 psi. It is desirable to let all of the hydraulic lines, valves, cylinders and the like to be fully primed to avoid air bubbles to the fullest extent possible and conventional procedures are employed for this purpose.

The elongated downhole apparatus 20 is then lowered down the well by the tubing string 22. As the sections of the string 22 are added at the well head, they are filled with fluid by the low pressure hose connection 32. When the apparatus 20 reaches the desired depth, the conventional hydraulic stabilizing anchor means 24 is actuated by hydraulic pressure applied through the tubing string 22 with the pressure causing wedge blocks 25 to move outwardly and engage the interior wall of the casing 12 so that the tool is effectively locked in a fixed position in the casing. It is also possible to use a conventional mechanically actuated anchor means.

Figure 19:
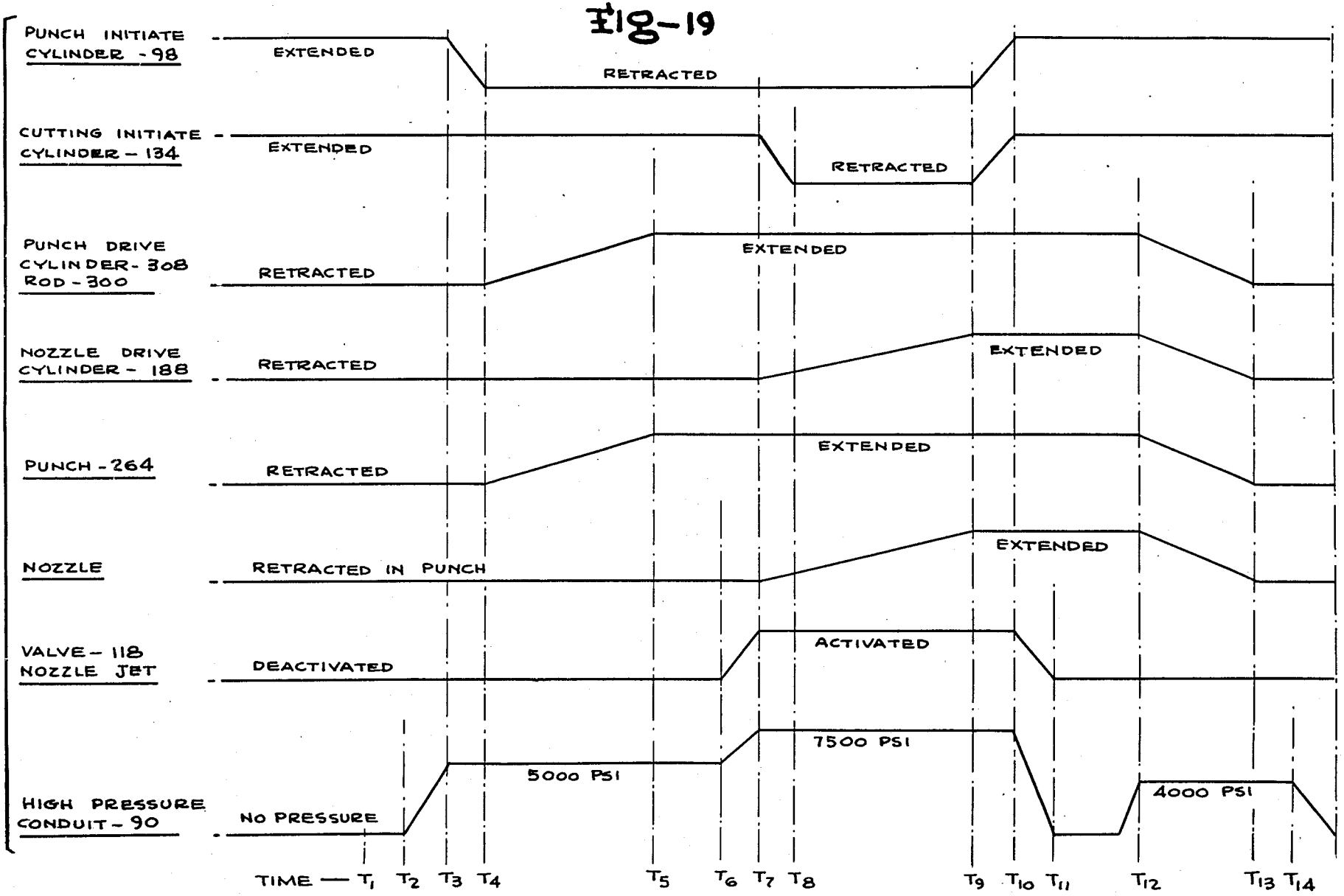
FIG. 19 is a timing chart illustrating a cycle of operation of the preferred embodiment.

High pressure hose 34 is then connected to the swivel 28 and the pressure applied to the string at the well head is then increased to 4,000 psi and held at that pressure for approximately 5 minutes to ascertain if there are any leaks in the system. If no leaks are detected, the pressure is released and the system is deemed ready for the beginning of the penetration procedure. At this stage of the cycle, the parts are in the positions illustrated in FIG. 18A and as reflected at $T_1$ in FIG. 19. Specifically, the piston 306 is in its lower retracted position and the punch member 258, 262, 264 is in its retracted position. The lance hose extend-retract rod 194 is in its retracted (upper) position and the nozzle jet 210 is positioned inside and fully enclosed within the axial aperture 353 extending through punch constituents 262, 264. At time $T_2$ the pressure at the surface is begun to be increased and reaches 5,000 psi plus the pressure drop due to frictional loss in the tubing at $T_3$. This pressure will be applied to high pressure conduit 90 and will consequently cause the pressure in the rod end of the first valve drive cylinder 98 to be sufficiently high to overcome the nitrogen gas pressure in accumulator 106 so that the piston in cylinder 98 moves from the extended position in FIG. 18A to the retracted position of FIG. 18B at time $T_4$.

The foregoing movement of the piston in cylinder 98 results in a shifting of the valve 118 to the position of FIG. 18B so that the high pressure is consequently applied to the head end of cylinder 308 to initiate upward movement of piston 306, connecting rod 300 and punch drive cam 256. Punch means 258, 262, 264 consequently begins to move toward the wall of the casing; however, the rate of movement is controlled by virtue of the fact that the fluid exhaust from the rod end of cylinder 308 is restricted by flow restriction means 109'. It takes approximately $1\frac{1}{2}$ (the time period $T_4$ to $T_5$) for the piston 306 to move from the retracted position of FIG. 18A to the extended position of FIG. 18B during which time the punch member 264, etc. will move from its fully retracted position through the intermediate position of FIG. 12 in which it engages the casing 12 the fully extended position which is reached at $T_4$ and which is shown in FIG. 11. It should be observed that the presence of slots 354 causes the punching operation to result in tab member 400, 402 being bent backwardly out from the casing but remaining connected to the casing. Thus, the portion of the casing that is removed from the casing to provide the aperture in the casing remains attached to the casing and cannot possibly interfere with operation of the nozzle jet or the flow of oil from the strata after the penetrating operation is completed. Rod 194 of cylinder 188 remains in the retracted position of FIG. 18A during the movement of the punch to its extended position due to the fact that the working pressure in high pressure conduit 90 is not sufficiently high to cause the oil pressure in the head end of cylinder 134 to overcome the gas pressure in the high pressure accumulator 126 and valve 150 consequently remains in the position illustrated in FIG. 18A.

After the punch member reaches its fully extended position, the system is permitted to remain at 5,000 psi for an additional 1½ minutes to permit the system to fully stabilize. At the termination of the stabilization period, the system is then ready for the beginning of the operation of nozzle means 210, etc. to effect penetration of the surrounding strata.

The strata penetrating operation is initiated at $T_6$ by initiating an increase in pressure in conduit 90 to a high pressure level equal to 7,500 psi plus the additional pressure loss in the string and downhole equipment. The higher pressure is reached at $T_7$. The increase in pressure does not have any effect on the position of valve 118 which remains in the position illustrated in FIG. 18B. However, the higher pressure is sufficient to shift the piston in cylinder 134 from its extended position to its retracted position (which is reached at $T_8$) by overcoming the gas pressure in high pressure accumulator 126. Valve 150 is consequently shifted at $T_8$ to the position illustrated in FIG. 18B to cause high pressure fluid to flow through line 172 to the head end of cylinder 188 which immediately begins to move from its retracted position toward its extended position. The rate of movement of the cylinder 188 is controlled by the restriction means 109 in exhaust line 108.

The application of high pressure fluid to the head end of cylinder 188 at time $T_7$, in addition to causing the piston and rod assembly 192, 194 to start moving downwardly and outwardly, also causes high pressure fluid to flow through passageways 191, 196, 204, 230 and 220 into hose member 209 to consequently activate the jet nozzle means 210 at the outer end of the hose member. The high pressure jets from the nozzle means 210 cut through the surrounding strata and the cutting are washed back into the casing through the slots 254 provided on opposite sides of the punch member constituents 262, 264. The high pressure pump is operated to provide 200 pressure pulsations per minute until the nozzle jet clears the punch member end component 264 at which time the frequency is increased to 500 pulsations per minute. The rate at which the nozzle jet is extended outwardly into the surrounding strata is controlled by restriction means 171 provided in the exhaust line 170 from cylinder 188. The hose means 209 and nozzle means 210 eventually reach the fully extended position illustrated in FIG. 4 at time $T_9$. A cavity 500 is consequently cut in the strata 14. The radial distance that the cavity 500 extends outwardly from the casing will be somewhat greater than the length of the stroke of the piston cylinder 188 due to the cutting effect of the fluid jet provided by the axial opening 374 in the nozzle block 372. It should also be appreciated that cylinder 188 can be made of substantial length so as to permit penetration outwardly from the casing to depths of 15 or more feet.

The system is maintained at the higher pressure level for a predetermined time period that is adequate to ensure full extension of the lance jet means. After expiration of this time period, reduction of the pressure in conduit 90 to zero is initiated at $T_{10}$ and zero pressure is quickly reached at $T_{11}$ to cause cylinder 98 and 134 to move to their extended positions by the force exerted from the gas in accumulators 106 and 126; the valves 118 and 150 are simultaneously returned to their positions illustrated in FIG. 18A. However, the components 194, 256, 262, 264, 306 all remain in the positions illustrated in FIG. 18B since there is no hydraulic pressure being applied to either of pistons 188 or 308 and they consequently remain in their extended condition, as shown.

Retraction of the lance is effected by increasing the pressure in conduit 90 to 4,000 psi at $T_{12}$. The 4,000 psi in conduit 90 flows through valve 118 and conduits 122, 182, 184, 334, 332, 330 and 318 to the rod end of cylinder 308 to initiate retracting movement of the piston 306 and associated punch drive cam 256. The rate of retraction is controlled by restriction 319 in an obvious manner and cylinder 308 reaches its fully retracted condition at $T_{13}$. Exhaust from the head end of cylinder 308 is discharged through check valve 110 which dumps into the housing of apparatus 20; however, weep holes (not shown) are provided in the housing to permit the exhaust fluid to flow into the casing in due course. The cylinder 188 is also actuated simultaneously at $T_{12}$ with cylinder 308 by virtue of the fact that pressure from conduit 90 flows through conduit 170 to the rod end of cylinder 188 to initiate retraction of the cylinder and the nozzle jet hose means 209, 210 etc. At the completion of this cycle at $T_{13}$, the punch member 262, 264 will be completely retracted to its initial position inside the casing and the hose member 206 will be completely retracted so that the nozzle jet 201 will be fully enclosed within the punch member. Pressure in conduit 90 is reduced to zero at $T_{14}$ and the apparatus is consequently placed in condition for either removal from the well or repositioning in the well.

Figure 4:
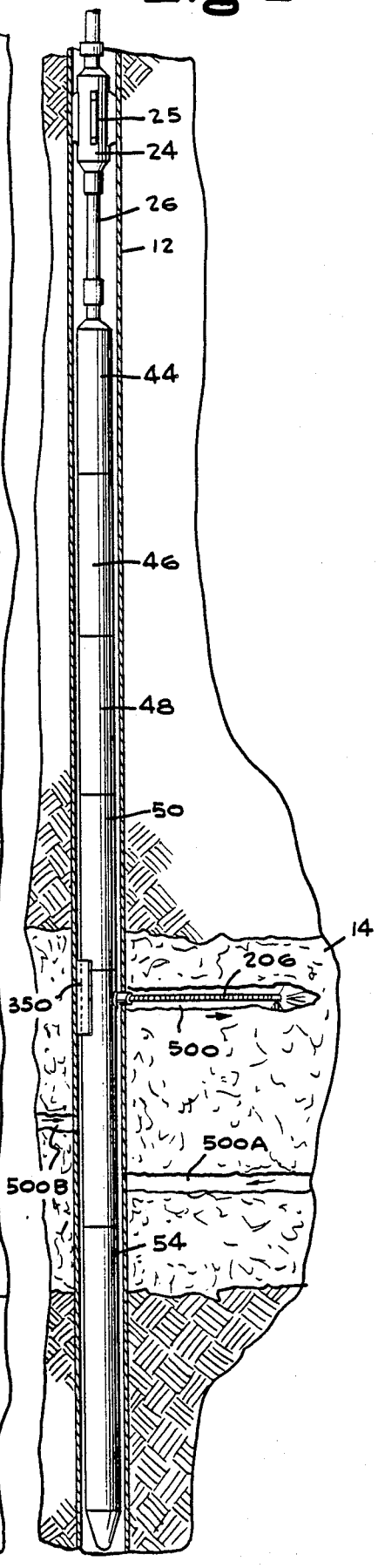
FIG. 4 is a sectional view similar to FIG. 3 but viewed from a angle of approximately 90° rotation to the left from the position of FIG. 3 and illustrating the activated condition of the equipment.

The stabilizing anchor means 24 can then be released to permit the downhole apparatus 20 to be removed to another position in the casing to effect a subsequent penetration of the surrounding strata. Movement of the tool can be either a simple rotation to a new position at the same depth in the casing or the entire tool can be lowered or raised to a different depth for the subsequent penetrating operation. FIG. 4 illustrates a second cavity 500A at a lower depth than cavity 500 and a third penetration cavity 500B at an intermediate level but at a different angle from the cavities 500 and 500A. After the desired number of penetrations, the entire tool is removed from the casing and production tubing and associated pumps or the like repositioned in conjunction with the well for the handling of production flowing from the surrounding strata 14.

Thus, it will be seen that the present invention is operative to effectively provide penetration of the surrounding strata outwardly to a depth and accuracy far exceeding that of prior known penetrating equipment. Moreover, the device is extremely reliable and trouble-free in that its entire operation is controlled solely by varying the pressure of the working fluid applied to the string at the well head. There is no need for sophisticated downhole sensors or control means or other sensible paraphernalia.

It should be understood that while the preferred embodiment of the invention is disclosed herein, numerous modifications will undoubtedly occur to those of skill in the art and the spirit and scope of the invention is to be limited solely by the appended claims.

I claim:

1. A punch member for providing an opening in a heavy workpiece such as a metal tube or sheet, said punch member comprising an elongated member having a generally cylindrical outer surface and curved cutting edge surfaces on one end of said generally cylindrical outer surface for initiating the provision of an opening and partially cutting such an opening in a metal workpiece such as a tube or sheet when urged axially thereagainst and longitudinal grooves bearing axes parallel to the axis of the punch member and intersecting and extending inwardly from said curved cutting edge surfaces for completing the opening by bending back tab portions of the workpiece on opposite sides of the opening in response to further axial movement of the punch member to complete the opening without severing any part of the workpiece moved to form the opening from the remaining portion of the workpiece.

2. The apparatus of claim 1 wherein said one end of said punch member comprises two substantially planar surfaces intersecting on a transverse line of intersection which extends transversely through the axis of the punch and wherein said cutting edge surfaces include the intersections of said planes with each other and the cylindrical surface of said punch member.

3. The apparatus of claim 2 wherein said longitudinal grooves are symetrically positioned relative to said transverse line of intersection.

4. The punch of claim 3 wherein said longitudinal grooves are rectangular in cross-section.

5. A punch member as recited in claim 1, additionally including a bore extending axially along the length of said elongated member.

6. The apparatus of claim 5 wherein said one end of said punch member comprises two substantially planar surfaces intersecting on a transverse line of intersection which extends transversely through the axis of the punch and wherein said cutting edge surfaces include intersections of said planes with the cylindrical surface of said punch member.

7. The apparatus of claim 6 wherein said longitudinal grooves are symetrically positioned relative to said transverse line of intersection.

8. The punch of claim 7 wherein said longitudinal grooves are rectangular in cross-section.

9. A punch member as recited in claim 2 wherein said two substantially planar surfaces are oriented in substantially perpendicular manner with respect to each other.

10. The apparatus of claim 9 wherein said longitudinal grooves are symetrically positioned relative to said transverse line of intersection.

11. The punch of claim 10 wherein said longitudinal grooves are rectangular in cross-section.

12. A punch member as recited in claim 9, wherein said transverse line of intersection passes through the longitudinal axis of said elongated member.

13. The apparatus of claim 12 wherein said longitudinal grooves are symetrically positioned relative to said transverse line of intersection.

14. The punch of claim 13 wherein said longitudinal grooves are rectangular in cross-section.

15. A punch member as recited in claim 12, additionally including a bore extending axially along the length of said elongated member.

16. The apparatus of claim 15 wherein said longitudinal grooves are symetrically positioned relative to said transverse line of intersection.

17. The punch of claim 16 wherein said longitudinal grooves are rectangular in cross-section.

* * * * *